United States Patent [19]

Wang

[11] Patent Number: 4,881,776

[45] Date of Patent: Nov. 21, 1989

[54] CHAIRS WITH FOLDABLE BACKS

[75] Inventor: Oliver Wang, Taipei, Taiwan

[73] Assignee: Casual Living International Inc., San Francisco, Calif.

[21] Appl. No.: 275,004

[22] Filed: Nov. 22, 1988

[51] Int. Cl.[4] ..... A47C 7/40

[52] U.S. Cl. ..... 297/379; 297/378; 403/96; 403/102

[58] Field of Search ..... 297/125–127, 297/354, 378, 379, 405, 408, 444; 403/93, 96, 102

[56] References Cited

U.S. PATENT DOCUMENTS

| | | | |
|---|---|---|---|
| 121,362 | 11/1871 | Hanner | 297/378 |
| 1,732,508 | 10/1929 | Farris | 403/96 |
| 1,791,765 | 2/1931 | Saunders et al. | 297/378 X |
| 2,042,886 | 6/1936 | Fergusen | 297/378 X |
| 2,400,630 | 5/1946 | Cramer et al. | 297/379 |
| 2,636,552 | 4/1953 | Long | 297/216 |
| 3,645,212 | 2/1972 | Dahlstrom | 403/102 X |
| 4,286,353 | 9/1981 | Roche | 403/102 X |

FOREIGN PATENT DOCUMENTS

| | | | |
|---|---|---|---|
| 83499 | 12/1956 | Netherlands | 403/102 |

*Primary Examiner*—Peter R. Brown

*Attorney, Agent, or Firm*—Marshall & Melhorn

[57] ABSTRACT

A chair structure has a lower chair seat section and an upper chair back section. The chair back section has a U-shaped upper back frame member and two lower back frame members. Each of the lower back frame members is connected to the upper back frame member by an upper connector and a lower connector which are respectively secured to the upper back frame member and the lower back frame member. The upper and lower connectors are rotatably interconnected by a pivot member and releasably interlocked by a lock mechanism. The lock mechanism may be either a spring biased ball unit or a nut and bolt unit. When the lock mechanism is released, the upper back frame member may be folded to rest on the lower back frame members.

1 Claim, 5 Drawing Sheets

CHAIRS WITH FOLDABLE BACKS

BACKGROUND OF THE INVENTION

This invention relates to chair sturctures, more particularly to chairs with foldable backs.

Referring to FIG. 1, conventional chairs are bulky and therefore expensive to ship and difficult to store. The volume occupied by an assembled chair is usually far greater than the volume occupied by the same chair in a disassembled condition. U.S. Pat. No. 4,750,784 teaches an improved chair structure, as shown in FIG. 2, in which the upper portion of the chair back can be removed from the remaining part of the chair so as to decrease the volume of the chair in shipping and storing. However, the removed chair back may be lost during the shipping process.

SUMMARY OF THE INVENTION

It is therefore the main object of this invention to provide chairs with foldable backs.

According to this invention, a chair structure includes a lower chair seat section and an upper chair back section. The chair back section has a generally U-shaped upper back frame member with two leg members, and two lower back frame members respectively connected to said leg members. A pivot means rotatably interconnects each of the leg members and the adjacent lower back frame member. The pivot means comprises an upper connector secured to the leg member, a lower connector secured to the lower back frame member, a pivot member rotatably interconnecting said upper and lower connectors, and a lock mechanism for releasably interlocking said upper and lower connectors against relative rotation therebetween. One of the upper and lower connectors has two first projections axially extending from an end thereof. The other of the upper and lower connectors has a second projection axially extending from an end thereof. The second projection is positioned between the first projections. All of the first and second projections have a transversely extending lug through which a pivot hole is formed. The pivot holes of the first and second projections are aligned with one another so that the pivot member can extend therethrough. When the lock mechanism is released, the upper back frame member may be folded to rest on the lower back frame members.

BRIEF DESCRIPTION OF THE DRAWINGS

Other features and advantages of this invention will become apparent in the following detailed description of two preferred embodiments of this invention, with reference to the accompanying drawings, in which.

DETAILED DESCRIPTION OF THE PREFERRED EMBODIMENTS

Figure 2:
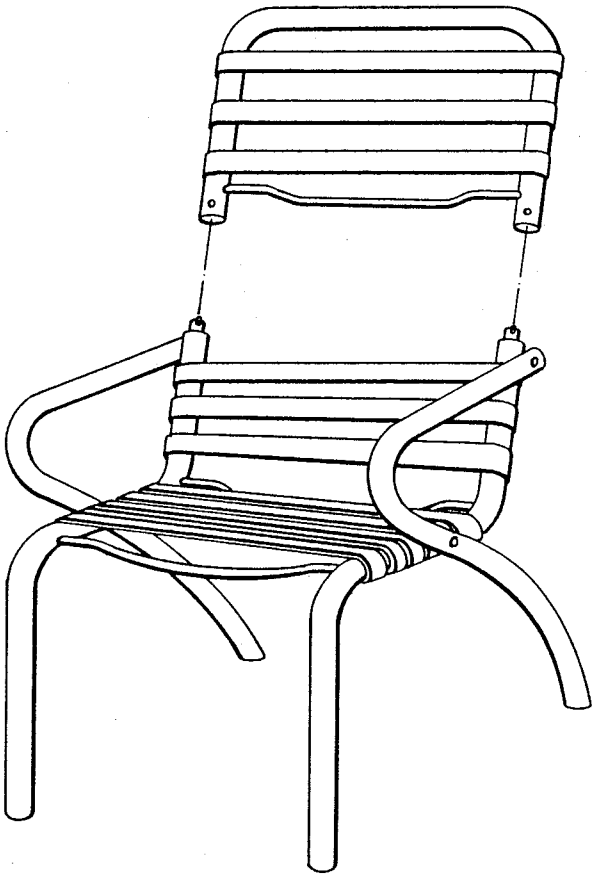
FIG. 2 PRIOR ART
FIG. 2 is a perspective view of a more advanced conventional chair.
Figure 1:
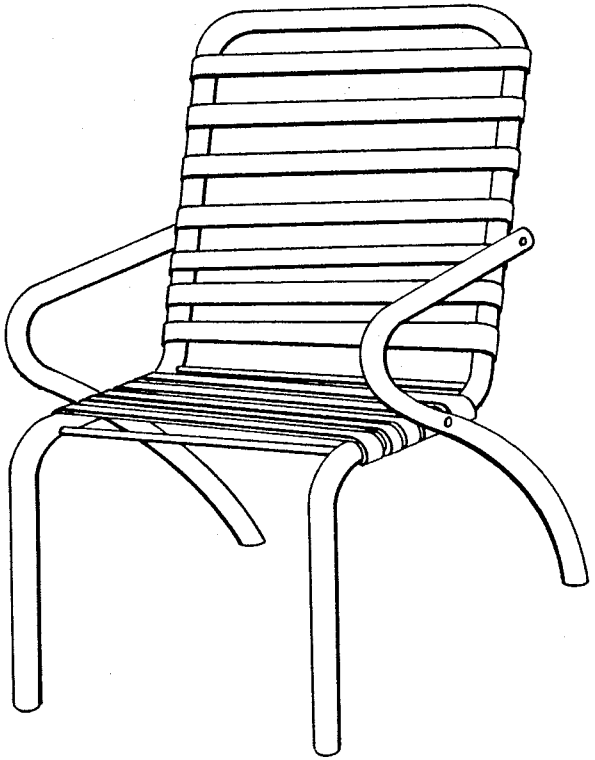
FIG. 1 PRIOR ART
FIG. 1 is a perspective view of an earlier conventional chair.
Figure 3:
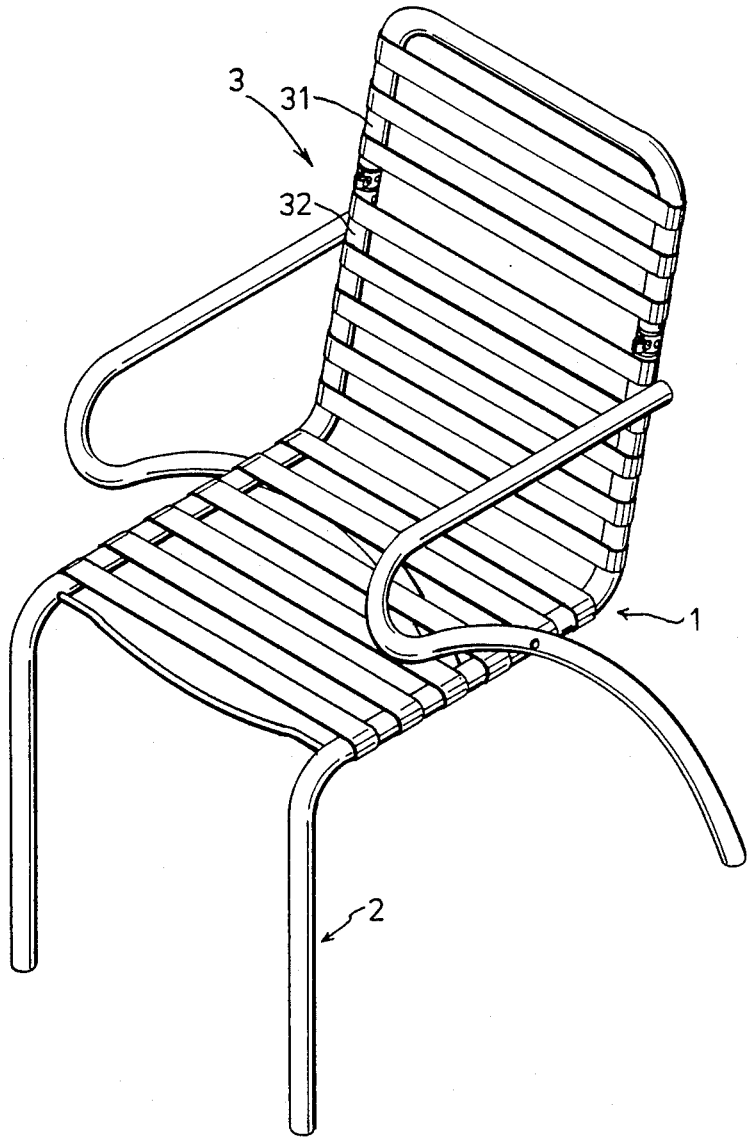
FIG. 3 is a perspective view of a chair according to this invention.

Referring to FIG. 3, a chair of this invention includes a lower chair seat section 1, a chair leg section 2 and an upper chair back section 3. The chair back section 3 consists of a U-shaped upper back frame member and two lower back frame members 32. The upper back frame member has two leg members 31.

Figure 4:
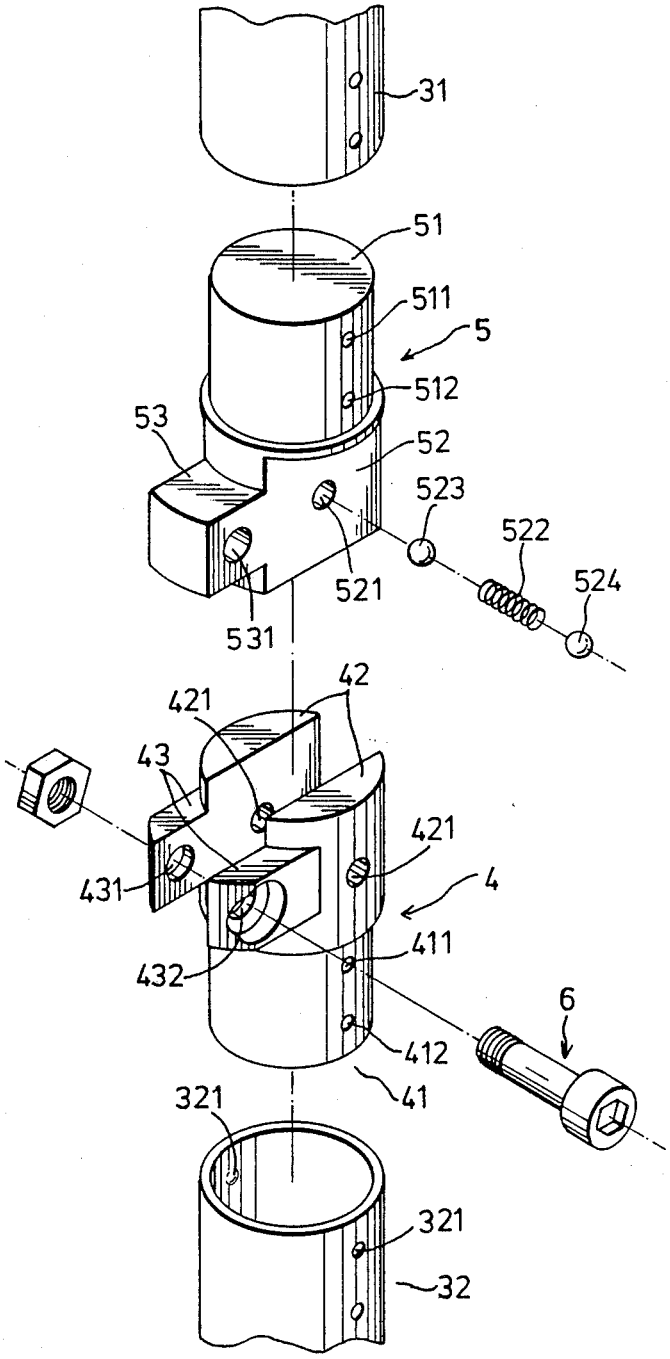
FIG. 4 is an exploded view showing a pivot means rotatably interconnecting an upper back frame member and a lower back frame member in accordance with this invention.

Referring to FIG. 4, the leg member 31 and the lower back frame member 32 are rotatably interconnected by a lock mechanism. The lock mechanism includes a lower connector 4 secured to the lower back frame members 32, an upper connector 5 secured to the leg member 31, a pivot member 6 rotatably interconnecting the lower connector 4 and the upper connector 5, and a lock mechanism releasably interlocking the lower connector 4 and the upper connector 5 so as to prevent relative rotation therebetween. In this embodiment, the pivot member 6 consists of a bolt and a nut.

The lower connector 4 has a cylindrical body 41 in which two small holes 411, 412 are formed. The cylindrical body 41 is inserted into one tubular lower back frame member 32. The lower back frame member 32 is then pressed so that two bumps 321 are formed on the inner surface thereof, (see FIG. 5), which engage with the small holes 411, 421 respectively, enabling the lower connector 41 to be fixed on the lower back frame member 32. Two parallel first projections 42 extend axially and upwardly from the upper end of the cylindrical body 41 and are each integrally formed with a transversely extending first lug 43 in which a pivot hole 431, 432 is formed. All of the first projections 42 and the first lugs 43 have a flatted inner surface.

The upper connector 5 also has a cylindrical body 51 in which two small holes 511, 512 are formed. The cylindrical body 51 and the leg member 31 are interconnected in the same manner as that of the cylindrical body 41 and the lower back frame member 32. A rectangular second projection 52 extends axially and downwardly from the lower end of the cylindrical body 51 and has a transversely extending second lug 53 in which a pivot hole 531 is formed. The second projection 52 has a thickness which is slightly less than the distance A between the first projections 42. In assembly, the second projection 52 is positioned between and parallel to the first projections 42 in such a manner that the pivot holes 431, 432, 531 of the first and second lugs 43, 53 are all aligned with one another, so that the pivot member 6 is passed through all of the first and second lugs 43, 53.

Figure 5:
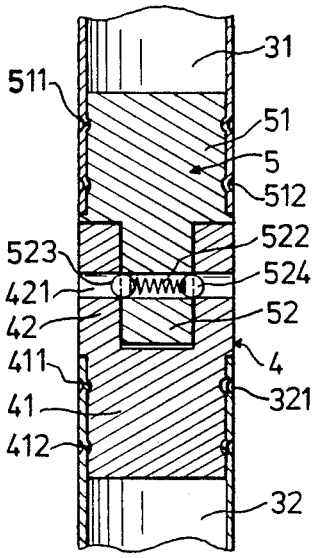
FIG. 5 is a schematic sectional view illustrating how to interlock the upper end and lower back frame members to prevent relative rotation therebetween in accordance with this invention.
Figure 6:
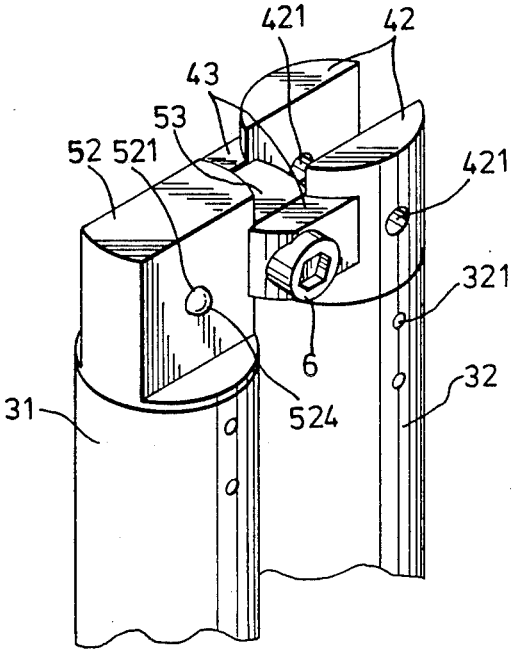
FIG. 6 is a perspective view showing the assembly of the upper and lower back frame members in a folded condition in accordance with this invention.

The lock mechanism includes a central hole 521 which is formed through the second projection 52, a spring 522, two balls 523, 524 retained within the central hole 521, and two positioning holes 421 formed through the first projections 41 respectively. Referring to FIG. 5, the balls 523, 524 are biased by the spring 522 so as to engage with the positioning holes 421 of the first projections 42, thereby locking the leg member 31 on the lower back frame member 32. When the leg member 31 is rotated relative to the lower back frame member 32, the balls 523, 524 automatically separate from the positioning holes 421 of the first projections 42. Referring to FIG. 6, the leg member 31 can therefore be easily folded so as to rest on the lower back frame member 32 for purpose of shipping or storing. Thus, when the folded chair is carried, the upper back frame member is not separated from the main body of the chair and therefore cannot be lost.

Figure 7:
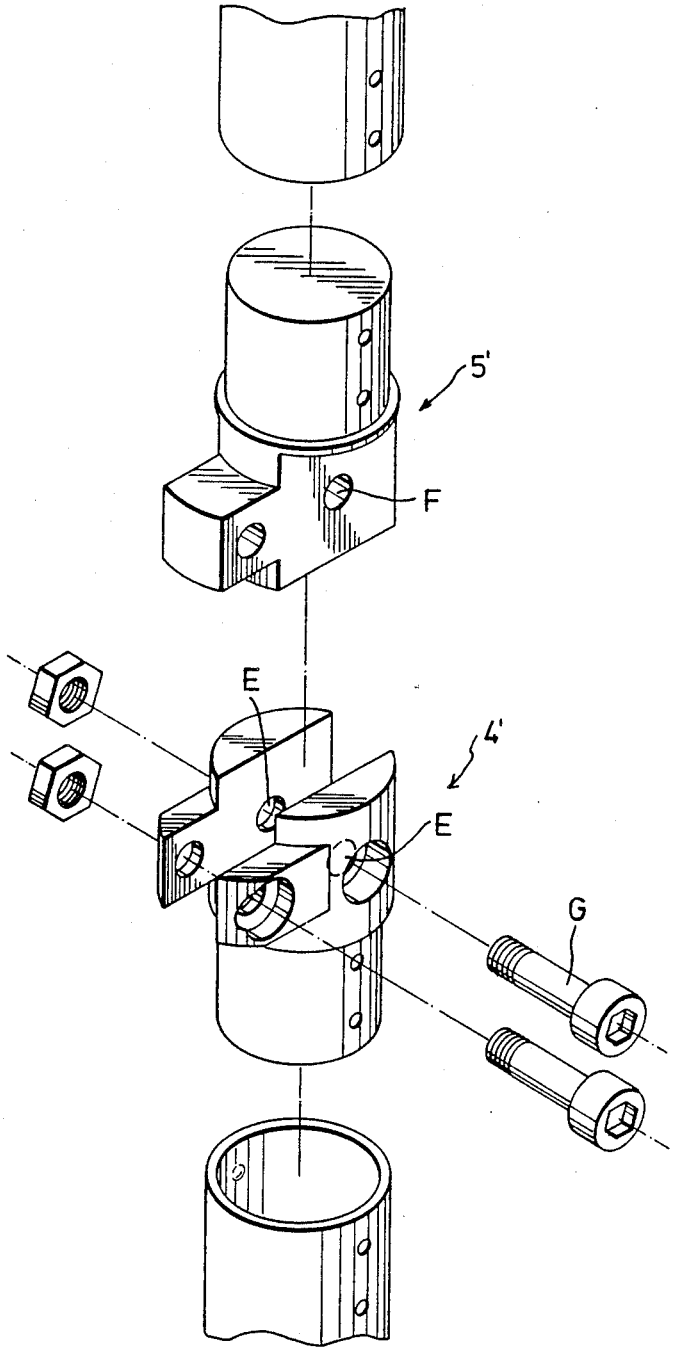
FIG. 7 is an exploded view showing another pivot means rotatably interconnecting an upper back frame member and a lower back frame member in accordance with this invention.

Referring to FIG. 7, the lock mechanism shown in FIG. 5 may be replaced with another lock mechanism which includes a locking bolt G extending through the screw holes E of the lower connector 4' and the screw hole F of the upper connector 5' so as to engage with a nut. When the locking bolt G is removed from the lower connector 4 and the upper connector 5, the leg member may be folded relative to the lower back frame member.

With this invention thus explained, it is apparent that numerous modifications and variations can be made without departing from the scope and spirit of this invention. It is therefore intended that this invention be limited only as indicated in the appended claims.

I claim:

1. A chair, comprising:

a chair seat and a chair back, said chair back connected to and generally upstanding from an edge of said chair seat;

said chair back including an upper back frame having two downwardly directed spaced-apart upper legs, and a lower back frame having two upwardly directed spaced apart lower legs, said lower legs connected to said upper legs by individual pivot means;

each of said pivot means including an upper connector secured to said upper leg, a lower connector secured to said lower leg, a pivot pin interconnecting said upper and lower connectors, and a lock mechanism for releasably interlocking said upper and lower connectors to prevent relative rotation therebetween, one of said upper and lower connectors including two spaced-apart generally parallel first projections extending from an end thereof, the other of said upper and lower connectors including a second projection extending from an end thereof, said second projection disposed between said two spaced-apart first projections;

each of said first and second projections including transversely extending parallel lugs through which coaxial pivot holes are formed for receiving said pivot pin, thereby allowing rotational relative movement between said upper and lower connectors;

said lock mechanism including at least one positioning hole formed in an inner surface of one of said first projections, and a spring and at least one spring biased ball retained in said second projection, said ball having a portion extendable from a surface of said second projection and urged by said spring to engage the positioning hole when said locking mechanism is in the locked position;

whereby, when said upper back frame is rotated relative to said lower back frame about said pivot pin, said ball moves away from the positioning hole thereby releasing said lock mechanism, and said upper back frame is folded so as to situate adjacent said lower back frame.

* * * * *